United States Patent [19]

Visser

[11] Patent Number: 4,545,065

[45] Date of Patent: Oct. 1, 1985

[54] EXTREMA CODING SIGNAL PROCESSING METHOD AND APPARATUS

[75] Inventor: Arie Visser, Canterbury, United Kingdom

[73] Assignee: XSI General Partnership, Washington, D.C.

[21] Appl. No.: 372,538

[22] Filed: Apr. 28, 1982

[51] Int. Cl.[4] ..... G10L 1/00

[52] U.S. Cl. ..... 381/41; 381/47

[58] Field of Search ..... 381/29–40; 364/513.5

[56] References Cited

U.S. PATENT DOCUMENTS

| | | | |
|---|---|---|---|
| 2,953,644 | 9/1960 | Miller | 179/15.55 |
| 2,962,553 | 11/1960 | Halina | 179/15.6 |
| 3,014,985 | 12/1961 | Raisbeck | 179/1 |
| 3,023,277 | 2/1962 | Mathews | 179/15 |
| 3,071,652 | 1/1963 | Schroeder | 179/15.55 |
| 3,125,723 | 3/1964 | Spogen, Jr. et al. | 325/38 |
| 3,139,487 | 6/1964 | Logan, Jr. et al. | 179/15.55 |
| 3,278,685 | 10/1966 | Harper | 179/1 |
| 3,280,266 | 10/1966 | Flanagan | 179/15.55 |
| 3,294,918 | 12/1966 | Gold | 179/15.55 |
| 3,327,063 | 6/1967 | Remley | 179/15.55 |
| 3,369,182 | 2/1968 | Reindl | 325/44 |
| 3,381,093 | 4/1968 | Flanagan | 179/15.55 |
| 3,416,080 | 12/1968 | Wright et al. | 324/77 |
| 3,505,601 | 4/1970 | Slaymaker | 325/38 |
| 3,528,011 | 9/1970 | Anderson | 325/38 |
| 3,624,560 | 11/1971 | Milton | 332/31 |
| 3,647,970 | 3/1972 | Flanagan | 179/1.5 |
| 3,659,052 | 4/1972 | Slavin | 179/15 |
| 3,746,791 | 7/1973 | Wolf | 179/15 |
| 3,800,093 | 5/1974 | Wolf | 179/15 |
| 3,833,767 | 9/1974 | Wolf | 179/15.55 |
| 3,855,555 | 12/1974 | Burkhard et al. | 332/11 |
| 3,974,336 | 8/1976 | O'Brien | 179/1 |
| 4,047,108 | 9/1977 | Bijker et al. | 325/38 |
| 4,093,821 | 6/1978 | Williamson | 179/1 |
| 4,271,332 | 6/1981 | Anderson | 179/1.5 |
| 4,382,160 | 5/1983 | Gosling et al. | 179/15.55 |

FOREIGN PATENT DOCUMENTS

| | | |
|---|---|---|
| 1487342 | 6/1973 | Fed. Rep. of Germany . |
| 2739609 | 9/1978 | Fed. Rep. of Germany . |
| 246855 | 1/1947 | Switzerland . |
| 848607 | 9/1960 | United Kingdom . |
| 1185095 | 3/1970 | United Kingdom . |
| 1279508 | 6/1972 | United Kingdom . |
| 1501874 | 2/1978 | United Kingdom . |

OTHER PUBLICATIONS

Effects of Differentiation, Integration and Infinite Peak Clipping upon the Intelligibility of Speech, by Licklider and Pollack, Journal of the Acoustical Society of America, vol. 20, No. 1, 1948, pp. 42–51.

Discrimination of Filtered/Clipped Speech by Hearing-Impaired Subjects, by Thomas and Sparks, Journal of the Acoustical Society of America, vol. 49, No. 6 (part 2), 1971, pp. 1881–1887.

Relative Intelligibility of Different Transforms of Clipped Speech, by Ainsworth, Journal of the Acoustical Society of America, vol. 41, No. 5, 1967, pp. 1272–1276.

Some Investigation into 'Infinite' Clipping of Steady State Signals and Application to Speech Processing, by King and James, IERE Conference on Signal Processing Methods for Radio Telephony, pp. 31–37, IEE, May 1970, London, England.

"Physicalische und Technische Akustik", by Meyer and Neumann, Wiesbaden, 1979, pp. 230–233.

*Primary Examiner*—E. S. Matt Kemeny

*Attorney, Agent, or Firm*—Kenyon & Kenyon

[57] ABSTRACT

High-frequency broadband noise (at frequencies above the lower-frequency analog information signal) is actually required for this system which transforms the information-plus-noise signal (FIG. 2*a*) into a binary-coded pulse-width-modulated signal (FIG. 2*c*) whose modulation represents the original information and noise. Such coding uses broadband infinite clipping to enhance the information to noise ratio, and also enhance the dynamic-range capability. A second embodiment synchronizes the binary-coded signal to a signal clock. Enhanced intelligibility for the hearing-impaired is discussed.

39 Claims, 13 Drawing Figures

EXTREMA CODING SIGNAL PROCESSING METHOD AND APPARATUS

BACKGROUND OF THE INVENTION

1. Field of the Invention

The present invention relates to the field of signal processing, and in particular, relates to the field of compressing the information contained in a signal into significantly smaller bandwidths than are required by conventional systems without loss of subjective quality. More particularly, the invention relates to a field of electronic signal processing which depends on the encoding of only the times of occurrence of maxima and minima, i.e., the extrema, of an analog waveform for the transfer of intelligible and high quality communications without the encoding of the amplitude values of the extrema themselves. The invention presents a novel model of the human sensory system, and particularly the auditory system. The invention has particular application in human sensory aid and simulation systems, speech processing, in bandwidth and data compression, in noise reduction systems and in subjective bandwidth extension.

2. Description of the Prior Art

Prior art signal amplification techniques make it possible to raise intensity levels of signals obtained from various sources such as transducers and devices that detect modulated signals. By amplifying the amplitude, signals become compatible with other devices such as recording, transmission and reproduction systems. Amplifiers find a large number of applications such as sound and video systems, hearing aids and sensory simulation systems. In the latter case, a lack of input dynamic range becomes noticeable since the human auditory system functions for signals having a dynamic range of 120 dB or more while electric amplifiers barely reach 100 dB. This effect causes distortion and/or insensitivity. Generally, dynamic range of a signal processing device is limited at one extreme by the signal to noise (S/N) ratio, and at the other extreme, by the power supply voltage. Thus, any system with essentially infinite dynamic range (>200 dB) must be able to process signals without being affected by one of these limitations. For example, a system in which information is converted into binary form, independent of the amplitude values of the analog waveform will satisfy this criteria. It has generally proved difficult, however, to maintain dynamic range while at the same time decreasing the bandwidth required for accurate frequency domain signal reproduction.

Methods for compressing the bandwidths required for information transfer are known. For example, delta modulation in which the differences between amplitudes of successive samples are encoded, offers bandwidth savings. Other systems include adaptive delta modulation, adaptive transform coding, vocal tract modeling and linear predictive coding. Although offering substantial bandwidth reductions, those systems suffer from complexity and in the case of the latter two systems, inability to transfer other than speech signals.

Methods for encoding only the characteristics relating to the extrema of an analog signal are known. In particular, techniques for determining the times of occurrence of extrema have been devised in the past. The process of detecting and encoding the times of occurrence of extrema is usually achieved by a signal processing circuit which comprises means for differentiating an input signal to shift minima and maxima to zero crossings, and an infinite clipper having a fast response time with respect to the bandwidth of the input signal for clipping the differentiated signal in order to detect these zero crossings.

In the early paper by Licklider and Pollack, "Effects of Differentiation, Integration, and Infinite Peak Clipping upon the Intelligibility of Speech," *Journal of the Acoustical Society of America* 20, 42–51 (1947), the intelligibility of distorted speech waveforms was investigated. It was discovered that intelligible, though poor quality speech could be obtained by the process of first differentiating the speech waveform followed by infinite peak clipping. Although this technique does solve the problem of input dynamic range, it was found that the performance is strongly degraded by background noise. Additionally, although the clipped signals are intelligible, quality is poor due to the information lost in the clipping stage of the process.

Another research effort, that by Thomas and Sparks, "Descrimination of Filtered/Clipped Speech by Hearing Impaired Subjects", *Journal of the Acoustical Society of America* 49, 1881–1887 (1971), investigated the intelligibility to hearing impaired persons of speech waveforms that had first been high pass filtered before clipping. It was found that intelligibility could be increased for some hearing impaired persons using this process. Again, however, this method suffers from the same problems noted by Licklider and Pollack.

In British Patent Specification Nos. 1501874 and 843607, techniques for measuring the times of occurrence of the maxima and minima are shown. In these systems, however, the amplitudes of the waveforms at the maximum and minimum points are also sampled and processed in addition to determining the times of occurrence of the signal extrema.

SUMMARY AND OBJECTS OF THE INVENTION

The present invention is predicated upon the discovery that the human sensory system, and in particular the ear, is more sensitive to the times of occurrence of maxima and minima in a signal than it is to the amplitude of these extrema. Thus, the present invention presents a novel model of the human sensory system, and in particular the auditory system, in which the information contained in a signal between the extrema points is basically redundant and unnecessary for information transfer. This can enable significant simplification to be made in various types of signal processing associated with the human sensory system and in particular can permit intelligible information to be processed using a reduced bandwidth and minimal information content without significant loss of subjective quality to the human sensory system.

Accordingly, it is an object of the present invention to develop a system which takes advantage of the above characteristics of the human ear to transmit information intelligibly and accurately by using only the time intervals between occurrences of the extrema of the analog waveform.

It is a further object of the invention to solve the background noise problems encountered by Licklider and Pollack in their investigations of differentiated and clipped signals. Although Licklider and Pollack investigated differentiated and clipped signals, the emphasis of their study was the determination of how much distortion the human ear could tolerate without loss of intelligibility. The present invention, on the other hand, is premised on the view that differentiating and clipping signals as a method of encoding extrema of the signals can result in maximum information transfer without subjective loss of quality. Significantly, the present invention differs from the proposals made by Licklider and Pollack in that it recognizes the importance of the response time of the clipper, a factor not appreciated by Licklider and Pollack.

Licklider and Pollack noted that the interval between spoken words was accompanied by high intensity noise signals. They proposed that, to eliminate these spurious signals, a repetitive (20 KHz) ultrasonic signal be introduced into the system. According to the present invention, the need for such superimposition of a repetitive signal is obviated by relying instead on the natural, random noise having a gaussian distribution which accompanies an analog waveform. Natural analog waveforms are invariably accompanied by high frequency noise related to the spectrum of the analog waveform. These variations are usually generated as random molecular noise or are the remains of earlier waveforms due to reverberation effects. As such, the noise will contain information about the particular environment from which the signals are obtained. When the superposition of signal and noise is differentiated and thereafter infinitely clipped at a sufficiently high slew rate, the output of the clipper will give a binary waveform with a significantly larger number of transitions than would be obtained if the signal were not accompanied by noise. When the output of the clipper is integrated, for example, an approximately zero intensity signal level will result so long as the waveform intensity is also approximately zero, thus allowing the reproduction of quiet passages or minimizing the noise between spoken words. Thus, if the clipper circuitry has a bandwidth which is greatly in excess of the analog waveform, for example, in the case of an audio signal, a clipper bandwidth of 50 KHz, though preferably in excess of 100 KHz, the background noise noted by Licklider and Pollack can be eliminated, and at the same time, a high quality distortion-free output signal obtained. Thus, instead of eliminating noise from the analog signal by filtering circuits or through other noise suppression techniques, the presence of the noise is itself utilized to provide high quality communications with a minimum amount of data. Thus, another object of the invention is to provide speech processing circuits which allows the transfer of data using rates much lower than those of conventional binary data transmission systems, such as pulse code modulation and the British patents cited above. For example, in the two British patents, information about the times of occurrence of the extrema and the amplitudes of the extrema are processed. In the present invention, the only information which is processed is the times of occurrence of the extrema, thus resulting in a much lower data rate. Compared to pulse code modulation, for example, in which an analog waveform is sampled and the amplitude converted into several bits of binary information, the present system uses only a transition from one binary level to another to represent the occurrence of an extrema, therefore allowing significant reduction in data rates.

It is still a further object of the present invention to provide circuitry which can function as a hearing aid for the sensory neural deaf, in accordance with the principle that the bulk of the information contained in a speech waveform is present not in the amplitudes of the waveform, but in the times of occurrence of the extrema.

Yet another object of the invention is to allow the compression of the bandwidths necessary for providing intelligible communications as compared to other conventional communications systems. This is directly attributable to the discovery that an analog waveform may be reduced to a binary signal indicating only the occurrence of extrema without encoding any other information present in the signal to convey intelligible and high quality speech.

Further, a corollary to the above is that the invention provides subjective bandwidth extension. Because the extrema encoded signal subjectively sounds the same to the listener as unmodified speech even though a reduced bandwidth is used to transfer the information, the bandwidth has effectively been extended.

These and other objects of the invention are provided for by circuitry which comprises means for differentiating the analog waveform in the presence of broadband noise to convert the times of occurrence of extrema in the waveform and noise to zero crossings. If the analog signal has been preprocessed to remove or bandlimit the background noise, means for reinserting the noise signals are provided. After the signal has been differentiated, it is fed into an infinite clipping circuit to provide a binary signal having transitions at the times when extrema occurred in the original signal superimposed with naturally occurring or reinserted broadband noise. The asynchronous binary output of the clipping circuitry can then be filtered, shaped and amplified or modulated and transmitted so as to provide communications. The output of the clipper can be further processed by suitable clocked synchronizing circuitry to provide synchronous communications transfer. If a sufficiently high clock rate is used, i.e., one having a repetition rate significantly greater than the maximum extrema rate, digital high fidelity is possible.

To recover the original analog signal from the clipper or synchronizing circuit output, integration, either acoustical or electronic, is required. For certain applications, where intelligibility rather than signal quality may be more important, for example, in a hearing aid for the sensory neural deaf or in speech recognition systems, other pulse shaping circuitry may be utilized.

The binary synchronous signal from the synchronizing circuitry may be further processed by suitable digital to analog (D/A) conversion means to provide an analog signal which can then be transmitted. Because the redundant information between extrema has been eliminated, the resulting bandwidth of the analog signal at the D/A output is significantly less than the bandwidth of the original analog signal. Thus, the object of providing analog bandwidth compression may be realized.

A signal which is suitably encoded by the system of the present invention may be transduced, transmitted or stored by devices of significantly simplified construction as compared with the prior art. For example, binary output devices, such as binary transducers, may be utilized with the system. Furthermore, because conventional transducer devices are not necessary to obtain the input signal, significant simplification and improvement in input transducer construction may be possible.

Additional objects and features of the invention will appear from the following description in which the preferred embodiments have been set forth in detail in connection with the accompanying drawings.

DETAILED DESCRIPTION

Figure 1A:
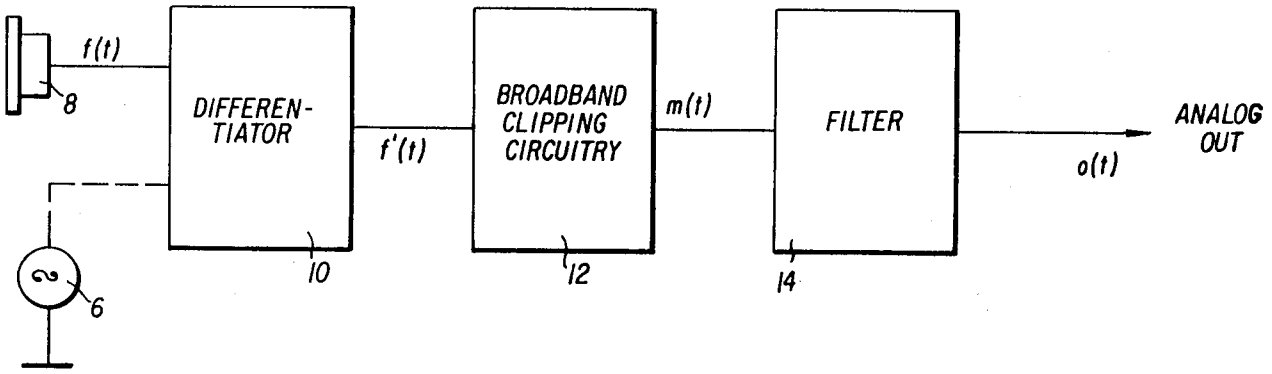
FIG. 1A is a block diagram of a first embodiment for extrema coding signal processing according to the invention.
Figure 1C:
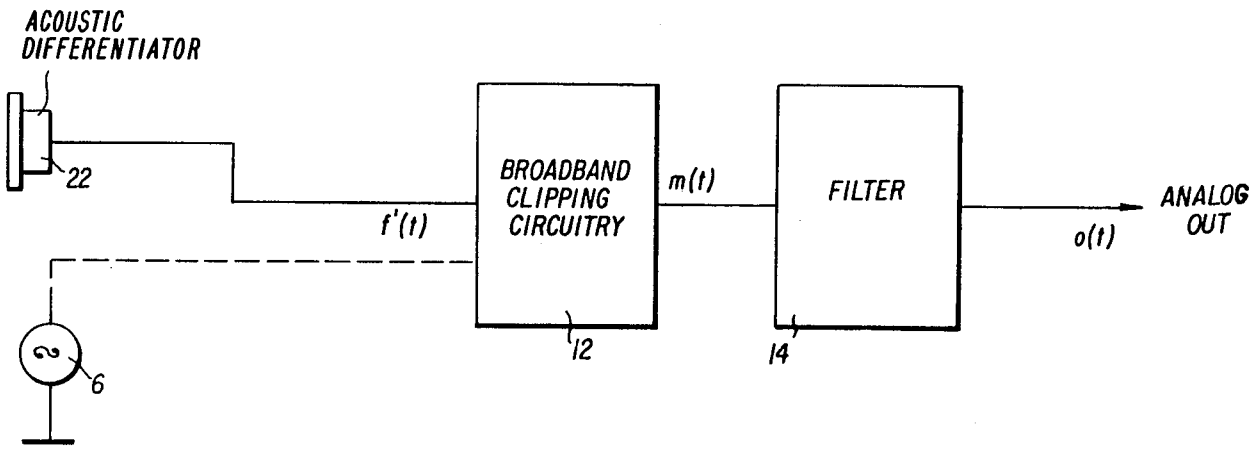
FIG. 1C is another embodiment showing extrema coding signal processing according to the invention.
Figure 2:
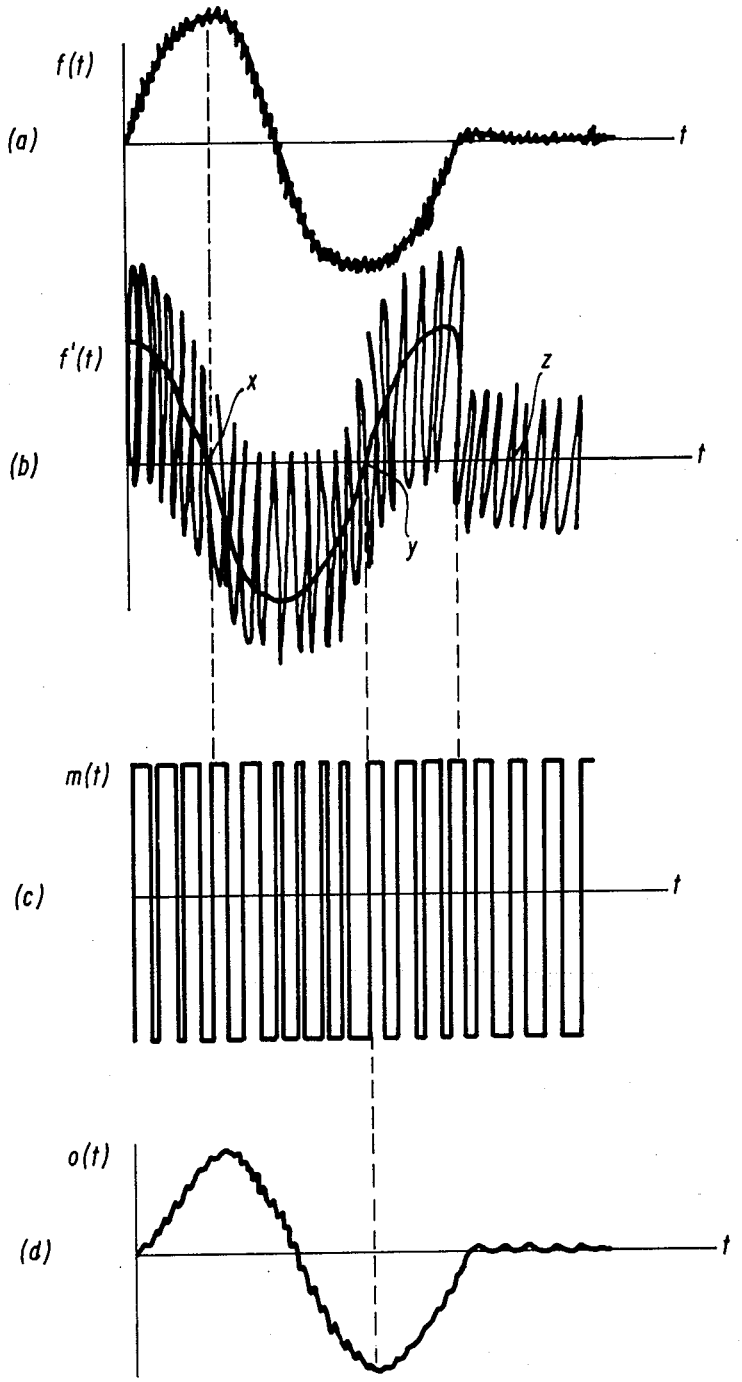
FIG. 2 illustrates several of the signals present in FIG. 1.

With reference to the drawings, FIG. 1A, B and C illustrate the basic extrema coding and decoding apparatus and method in block diagram form. A signal from transducer 8, which may be a microphone or other suitable source of input signal, is fed into differentiating circuit 10, which can be a simple resistor capacitor network or active differentiating circuit. The differentiation may be approximated by various high pass filters. Preferably, the filter has a linear characteristic of 6 dB/octave for optimum results. Alternatively, a differentiated signal may be obtained acoustically or by some other process known in the art by specially designed transducers designated as 22 in FIG. 1C. For example, transducers with appropriate mechanical filters can be employed which differentiate the input signal acoustically. FIG. 2(*a*) illustrates a typical analog signal f(t) at the input to the differentiator superimposed with broadband noise, i.e., noise having a bandwidth substantially greater than the bandwidth of the analog signal. FIG. 2(*b*) illustrates the signal at the output of the differentiator, f'(t). The high frequency noise components have been emphasized by the process of differentiation, and all extrema are now represented by zero crossings, including noise extrema as shown in FIG. 2(*b*). Thus, the presence of the noise results in a signal from the output of the differentiator which has many more zero crossings than would appear if there were little or no noise. If the noise were not present, it would not be possible to recover a high quality non-distorted signal from the system output. If noise is not present from the input 8, for instance, if the noise had been suppressed by a previous circuit, for example, a DOLBY circuit, broadband noise having a gaussian distribution can be introduced from a suitable gaussian noise source 6.

The differentiator output is then fed into an infinite clipper 12 having a bandwidth much wider than the input signal. For instance, if a high fidelity output signal is desired, a clipper bandwidth in excess of 100 KHz may be required. The output of the clipper is shown in FIG. 2(*c*) as m(t). The clipper has a very fast response time and is sensitive to voltage variations of a few micro volts. As shown in FIG. 2(*c*), the clipper output is a series of varying width binary pulses, the width of the pulses being determined by the times between occurrences of extrema of the noise superimposed on the input signal f(t). When the average value of the differentiator output is greater than zero, it will be found that the negative going pulses have very minimal widths, while positive going pulses are wider. When the average value of the differentiated signal is zero, as shown at x, y or z in FIG. 2(*b*), the positive and negative going pulses will have equal widths. When the average value of the differentiator output is less than zero, the negative going pulses will have greater widths. Thus, information about the occurrence of extrema in the original analog signal including the noise has been converted into a series of binary pulses. The importance of the noise signal in creating this binary waveform and in proper recovery of the waveform is apparent from FIG. 2. It can be seen from FIG. 2 that the times of occurrence of extrema are represented by transitions of the binary signal of FIG. 2(*c*). Information about the amplitude of the analog signal f(t) is represented by the times of occurrence of extrema in the noise superimposed on the signal f(t), i.e., the pulse widths. Frequency information is contained in the repetitive nature of the signal of FIG. 2(*c*), for example, the times of occurrences of the average value zero crossings corresponding to points x, y and z of FIG. 2(*b*).

This binary signal is then fed into a suitable filter or other pulse shaper 14 in order to recover the signal. If the pulse shaping circuit is an integrator, the original waveform can be nearly restored in a way related to the properties of the random noise as shown in FIG. 2(*d*) by the signal o(t). The faster the response of clipper 12, the higher the quality of the output signal.

The amplitude of the reproduced waveform will be found to be related to the properties of the random noise present or inserted with the input signal f(t). For example, when the noise is intense, some amplitude compression will occur. When the noise is of low intensity, amplitude expansion will occur. These particular effects are due to the non-linear characteristics of the circuitry involved at high and low input levels.

Figure 1B:
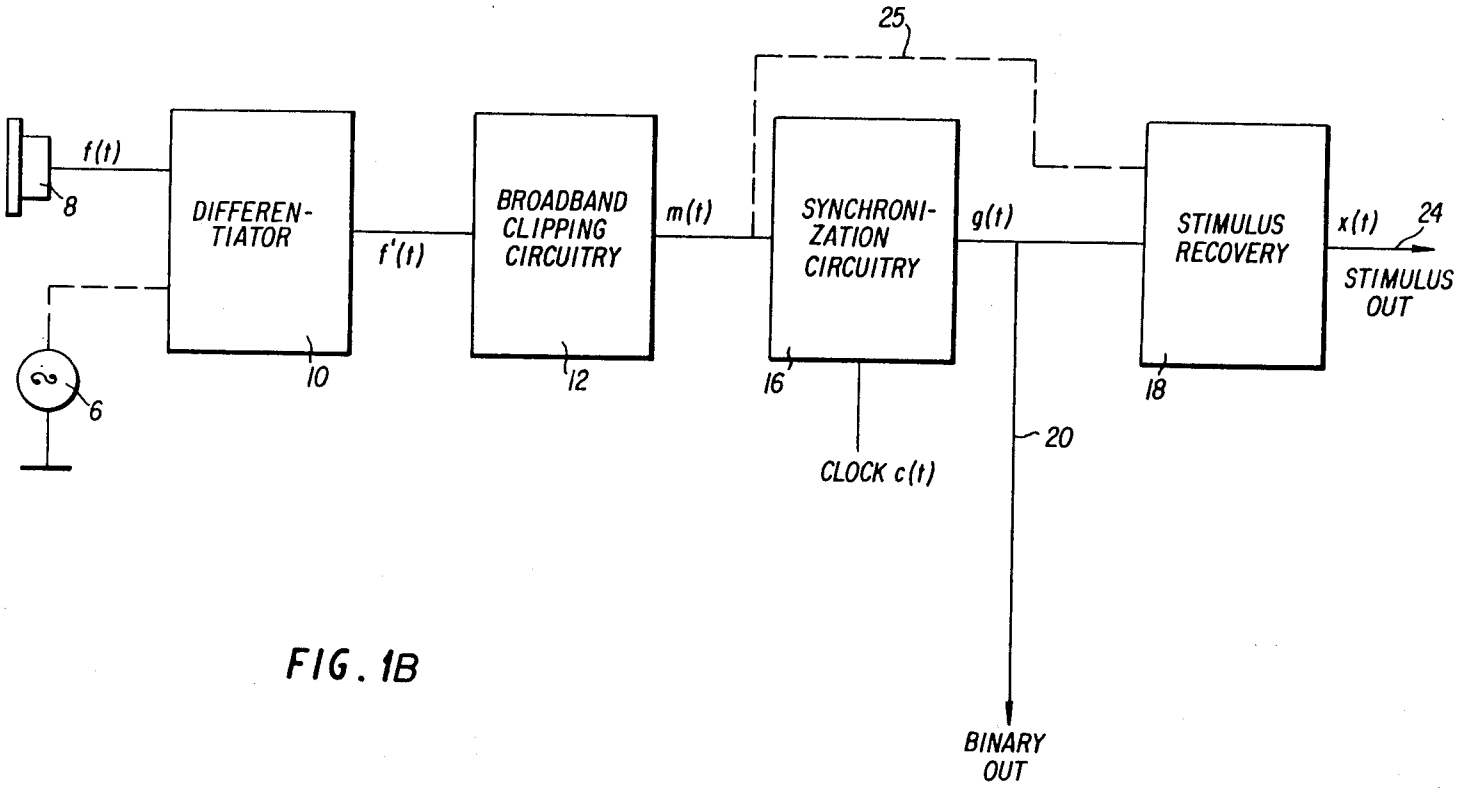
FIG. 1B is a second embodiment showing extrema coding signal processing according to the invention.
Figure 2A:
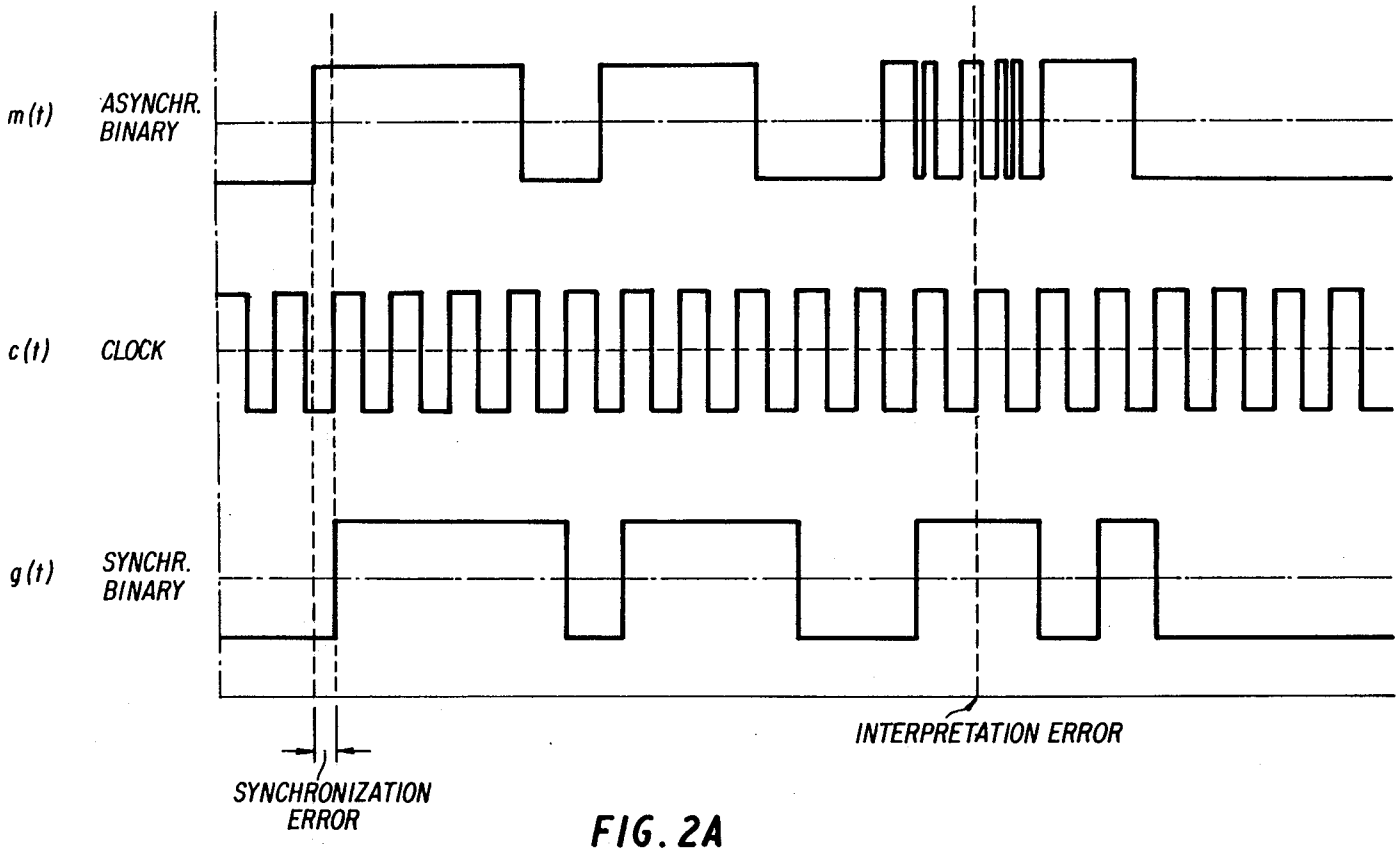
FIG. 2A illustrates the clock signal and signals present at the input and output of the synchronization circuitry of FIG. 1B on a greatly expanded time axis.

In order to provide a synchronous output, synchronization circuitry 16 as shown in FIG. 1B may be utilized. A D-type flip-flop can serve this function. In FIG. 2A, the signal m(t) of FIG. 2 at the input to the synchronizing circuitry is shown on a greatly expanded time axis. As illustrated, it is an asynchronous binary signal. The clock with which m(t) is to be synchronized is shown as c(t). For each rising edge of the clock pulse, the signal at the input will be transferred to the output after a small delay time. The synchronous binary output signal g(t) on line 20 can then be fed into a communications channel and to other conventional digital devices. Two types of error may occur, synchronization error and interpretation error, as shown in FIG. 2A. As long as the clock repetition rate is sufficiently high, however, synchronization will not unduly degrade system performance. Distortion will occur if the clock rate is less than the maximum extrema rate as shown by the interpretation error of FIG. 2A. For some applications, however, some distortion may be inconsequential. As long as the signal is highly intelligible, e.g. in speech recognition systems and in hearing aids, distortion may be tolerated.

The signal g(t) can be fed into further pulse shaping devices, represented by the stimulus recovery block 18 in FIG. 1, which can be a filter, integrator or other pulse shaping circuit. The output signal on line 24 is then fed into a suitable amplifier and/or output transducer, such as a loudspeaker or hearing aid output transducer, for example.

Figure 3:
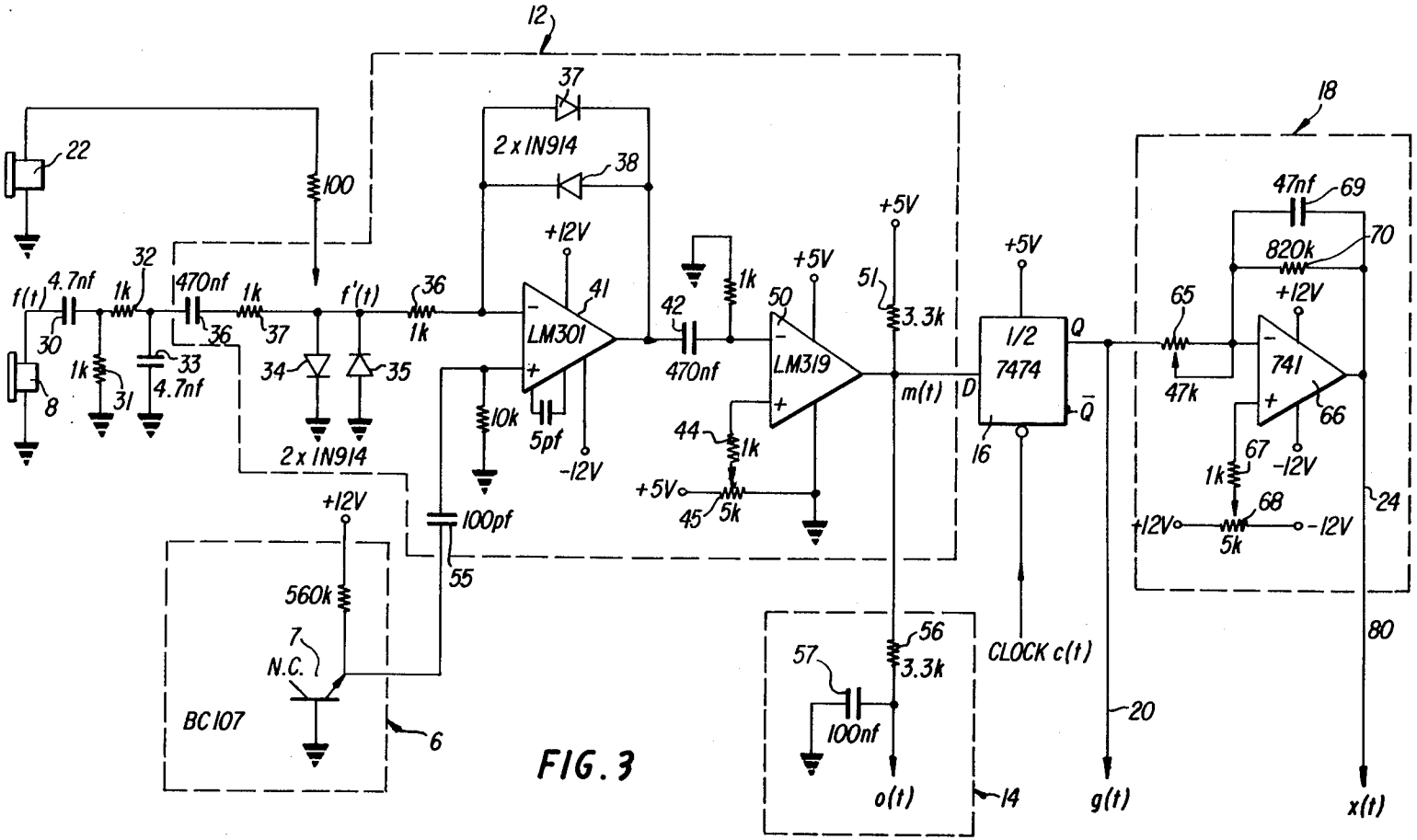
FIG. 3 is a schematic diagram of a circuit which processes signals according to the invention.

Shown in FIG. 3 is a circuit which implements the functions shown in FIGS. 1A, 1B, 1C, 2 and 2A. Input from transducer 8 is fed into a differentiator circuit comprising capacitor 30 and resistor 31 in parallel with the input impedance looking into the circuit after capacitor 30. Input voltages from transducer 8 are typically on the order of 10 muv. Resistor 32 and capacitor 33 form a high pass filter for filtering out the very high frequency components of the noise present in the signal. The differentiated signal is then coupled through capacitor 36 and resistor 37 into infinite clipping circuit 12. Diodes 34 and 35 provide under and over voltage peak protection. The signal coupled into the inverting terminal of op-amp 41 through resistor 36 has a magnitude of approximately 1 uv at the inverting input terminal. Op-amp 41 and associated circuitry form a high bandwidth preamplifier. Diodes 37 and 38 in the feedback circuit increase the frequency response of the preamplifier. The preamplifier has a non-linear response for high and low intensity signals. For low intensity signals, the preamplifier provides high gain. At high intensities, the preamplifier will provide low gain, thus acting as a limiter of the signals coupled into comparator 50 and aiding clipping. Typically, the voltage levels at the output of op-amp 41 will vary between $\pm 1$ mv for low intensity input signals, and $\pm 0.7$ v for high intensity input signals. If sufficient random noise is not present at the differentiator input, noise can be introduced from noise source 6. The noise source might be, for example, the open collector emitter-base junction noise of a bipolar transistor 7 coupled through coupling capacitor 55 to the non-inverting input of op-amp 41.

Capacitor 42 couples only the A.C. component of the output from op-amp 41 into the negative input of comparator 50, which is a fast comparator having an input sensitivity of less than 1 mv. Resistor 44 and variable resistor 45 serve to vary the reference voltage at which comparison occurs. The output of comparator 50 is an asynchronous signal corresponding to m(t) of FIG. 2. The output is pulled up to a maximum of $+5$ volts by resistor 51. The signal m(t) may then be fed into filter 14, which may be a low pass filter or integrator as shown. The integrator comprises resistor 56 and capacitor 57, and substantially recovers the original input signal f(t) from the extrema encoded signal. Filter 14 may also be a low pass filter which bandlimits the extrema encoded binary asynchronous signal below a certain frequency. It has been found that such a bandlimited extrema encoded signal offers better subjective audio quality than a similarly bandlimited analog signal. In fact, the extrema encoded signal may be bandlimited substantially below the corresponding analog signal and still offer comparable subjective audio quality. For many applications, however, complete reproduction of the original signal may be unnecessary, i.e., in a hearing aid for the sensory neural deaf, intelligibility may be more important than quality. Because the human sensory system is more sensitive to extrema than to the information contained between extrema, completely accurate reproduction is not necessary. This has the advantageous effect that the system effectively reduces the information content of the input signal without significantly altering the sensation perceived when the extrema encoded signal is directly supplied to the human sensory system, i.e., the signal subjectively sounds the same as the original waveform, though in the time and frequency domain analysis it may appear very different.

The clipper output can be fed into the synchronizing circuit comprising D flip-flop 16 as explained earlier with reference to FIG. 2A. On each rising edge of the clock c(t), the data at the input of the flip-flop is clocked to the output. After synchronization with the clock c(t), the signal g(t) can be applied to digital storage, transmission or reproduction devices on line 20. The output of D flip-flop 16 may then be fed into stimulus recovery block 18 of FIG. 1A. In FIG. 3, an active integrator is used to recover the original waveform f(t) from the extrema encoded signal comprising op-amp 66 and associated components. Resistor 70 and capacitor 69 form the feedback network of the integrator. Variable resistor 65 changes the magnitude of the signal present at the inverting input of op-amp 66, while variable resistor 68 and resistor 67 form a voltage divider circuit for establishing the correct bias on the non-inverting input. The voltage divider biasing circuit is necessary because the Q output signal of flip-flop 64 varies between approximately 0 and 5 volts. Alternatively, the Q output of flip-flop 64 could be capacitively coupled to op-amp 66 to block the D.C. component. The output of the integrator on line 24 is an analog signal corresponding to the original input signal f(t).

Figure 3A:
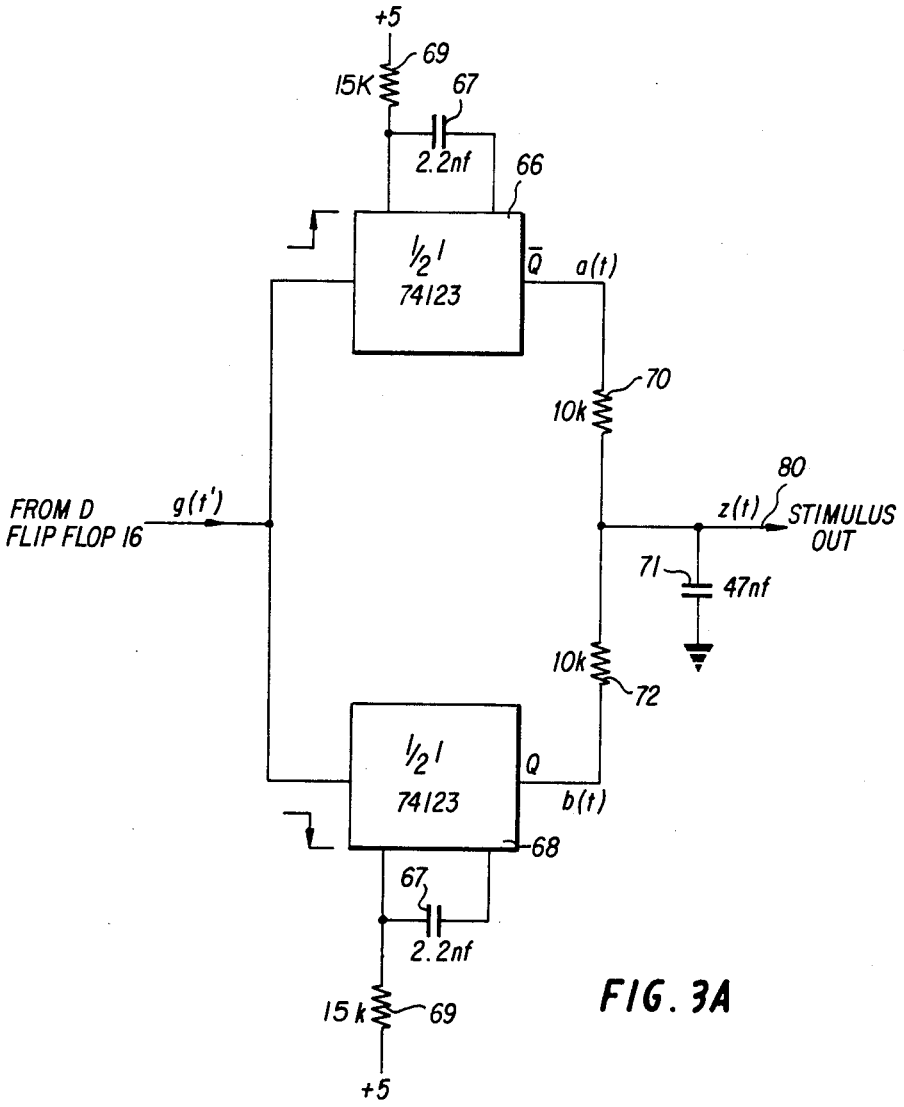
FIG. 3A illustrates an alternative stimulus recovery block of FIG. 1B.
Figure 3B:
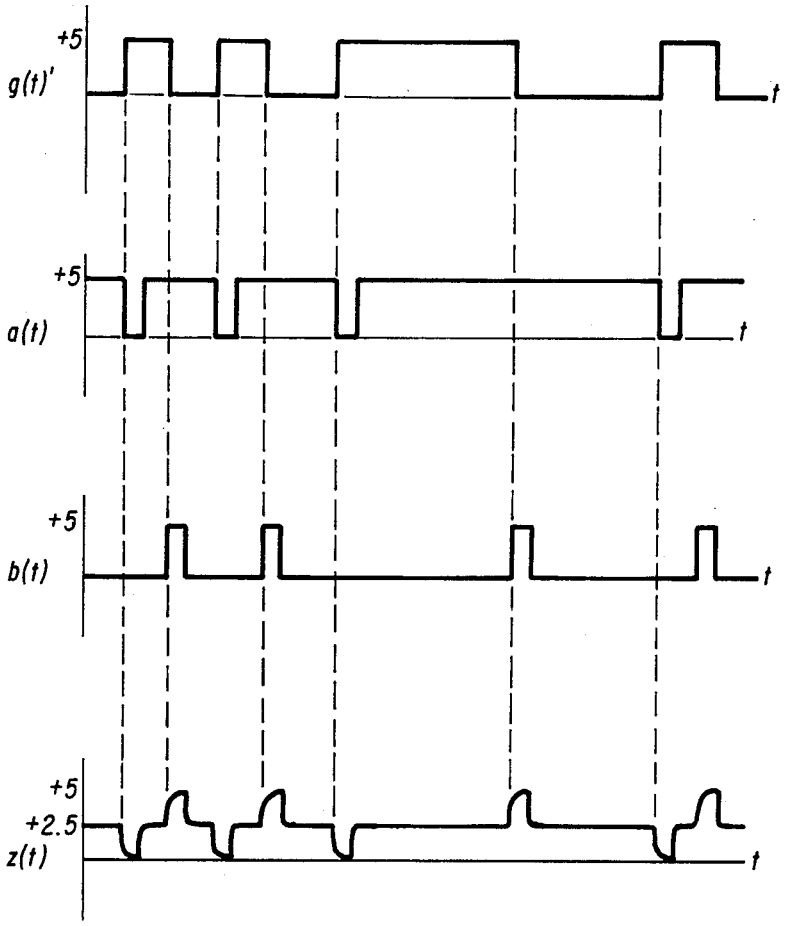
FIG. 3B is a timing diagram of the waveforms of FIG. 3A.

A further implementation of the synchronized output may be performed by the dual monostable multivibrators 66 and 68, of FIG. 3A, one of which triggers on the positive edge of a pulse, and the other of which triggers on the negative edge. This pair of monostable multivibrators forms another embodiment of the stimulus recovery block 18 of FIGS. 1A, 1B, 1C. The timing diagram is shown in FIG. 3B. Each monostable multivibrator must give short pulses of duration shorter than the clock period at both positive and negative going edges of the binary waveform. The pulse widths are determined by timing components, resistors 69 and capacitors 67. As shown in FIG. 3A, the positive edge triggered monostable multivibrator 66 has its Q output coupled to line 80 via a resistor 70, and the negative edge triggered monostable multivibrator 68 has its Q output coupled to line 80 via a resistor 72. The output of the two monostables are shown as a(t) and b(t) in FIG. 3B. Because the two resistors 70 and 72 form a voltage divider, the output waveform is centered about 2.5 v as shown by z(t) in FIG. 3B. Thus, the output on line 80 will be a series of pulses corresponding to the times of occurrence of the extrema in the original waveform. The resistor-capacitor network comprising the two resistors 70 and 72 and capacitor 71 form a filter which insures that there will be only one effective extremum during one period of the clock.

The particular output block shown in FIG. 3A comprising the two monostable multivibrators 66 and 68 and associated circuitry are especially advantageous in hearing aid devices for the sensory neural deaf. In persons suffering from sensory neural deafness, extremely intense signals may be required to allow hearing. Supplying such intense signals is often damaging or painful to the sensitive middle ear. The sensory neurons of the cochlea in the inner ear, however, are much more sensitive to the extrema of the sound waveform than the amplitudes of these signals. Thus, a train of short pulses corresponding in time to the extrema of the input signal will provide intelligible information to excite the sensory neurons without undue strain of the middle ear because of the limited energy of the short duration pulses. As shown in FIG. 1A by line 25, it is also possible to feed the asynchronous clipped signal m(t) into this output block.

Figure 4:
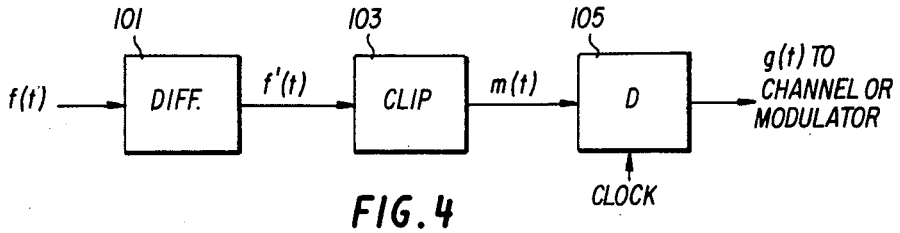
FIG. 4 illustrates how low data rate synchronous communications can be obtained.

The device of the present invention has many applications. FIG. 4 is the block diagram for a synchronous communications device. The device consists of differentiator 101, broadband clipper 103 and D flip-flop synchronizing circuit 105. An important advantage of this system is that, for a given intelligibility, a lower data rate can be used than in conventional digital communications systems. This is so because information concerning the amplitude of the analog signal has been discarded, other than the times of occurrence of extrema. This method of communications may be applied to video as well as audio information.

Within the field of audio signals, the reduction of the amount of data necessary to represent a sound or speech signal considerably simplifies the task of speech and voice recognition. Furthermore, the reduction of the baud rate in such fields as video transmission and recording may enable significant simplification of the systems required, giving the potential capability of allowing a television picture to be reproduced using only the bandwidth conventionally required for audio signal processing.

Figure 5:
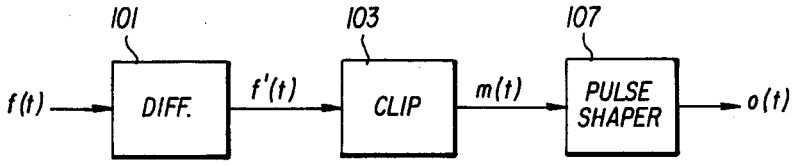
FIG. 5 is a block diagram of a hearing aid for the sensory neural deaf utilizing the basic system of the invention.

In FIG. 5, the block diagram for a hearing aid is shown. Blocks 101 and 103 perform the same functions as described with reference to the other figures. Block 107 is a pulse shaping circuit which may be a low pass filter, integrator or the dual monostable multivibrator circuit described in FIGS. 3A and 3B, for example. It has been found, for example, that bandlimiting the extrema encoded signal m(t) to 3 KHz results in AM radio quality speech in normal listeners, and can significantly improve intelligibility to deaf listeners.

Figure 5A:
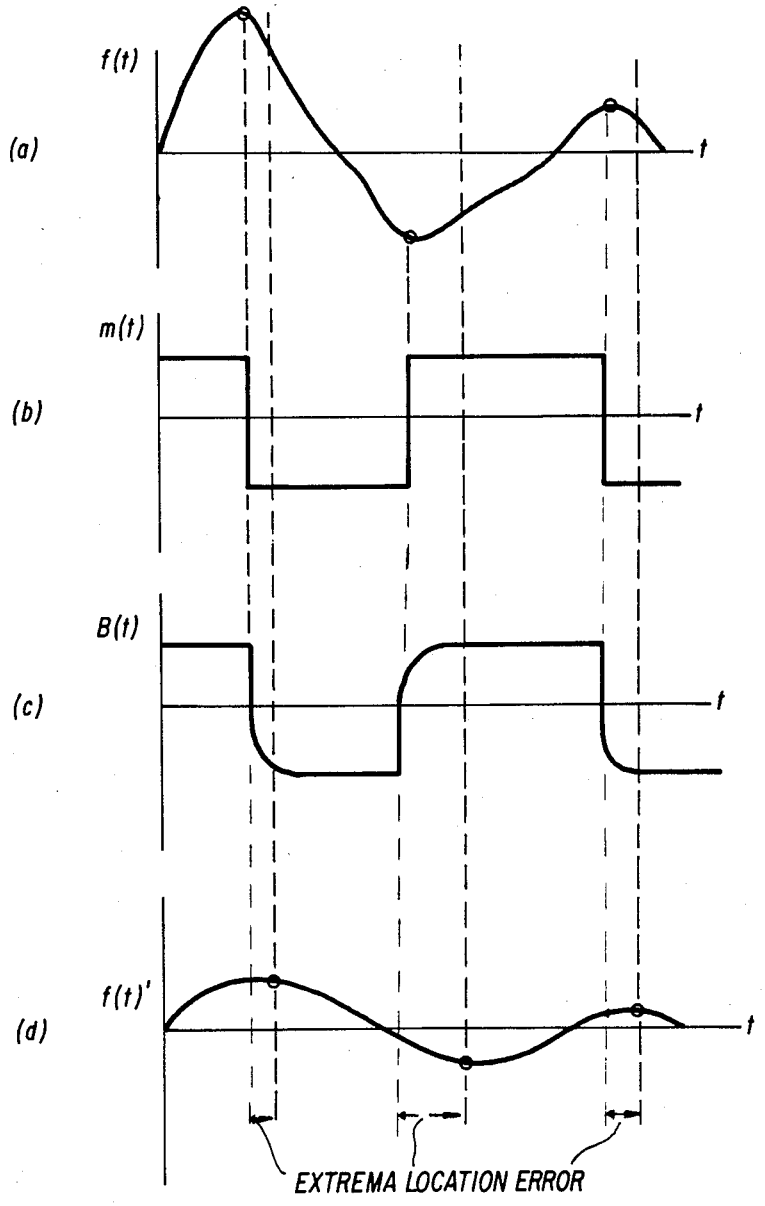
FIG. 5A illustrates how the system provides subjective bandwidth extension.

FIG. 5A illustrates why the system provides subjectively higher quality signals than would a conventional system which is bandlimited to the same extent, and thus in effect, provides subjective bandwidth gain. According to the discovery that the human sensory system is responsive to the extrema contained in an analog signal and that the shape of the waveform between extrema is redundant, a waveform such as FIG. 5A(*a*) will appear like (*b*) in FIG. 5A after differentiation and clipping. After low pass filtering to a bandwidth B, which might be accomplished by a filter circuit or by acoustic filtering in the ear itself, a waveshape similar to FIG. 5A(*c*) will result. The times of occurrence of extrema will not have appreciably changed despite low pass filtering as shown in FIG. 5A(*c*). FIG. 5A(*d*) shows a signal f(t)' which is the signal f(t) but bandwidth limited by a low pass filter of bandwidth B. The times of occurrence of the extrema are appreciably shifted by the low pass filter, and the waveform will therefore be perceived as being more distorted than the extrema encoded signal. Thus, in effect, the extrema encoded signal has subjectively brought within the bandwidth B frequencies which would be lost using conventional filtering techniques.

Figure 6:
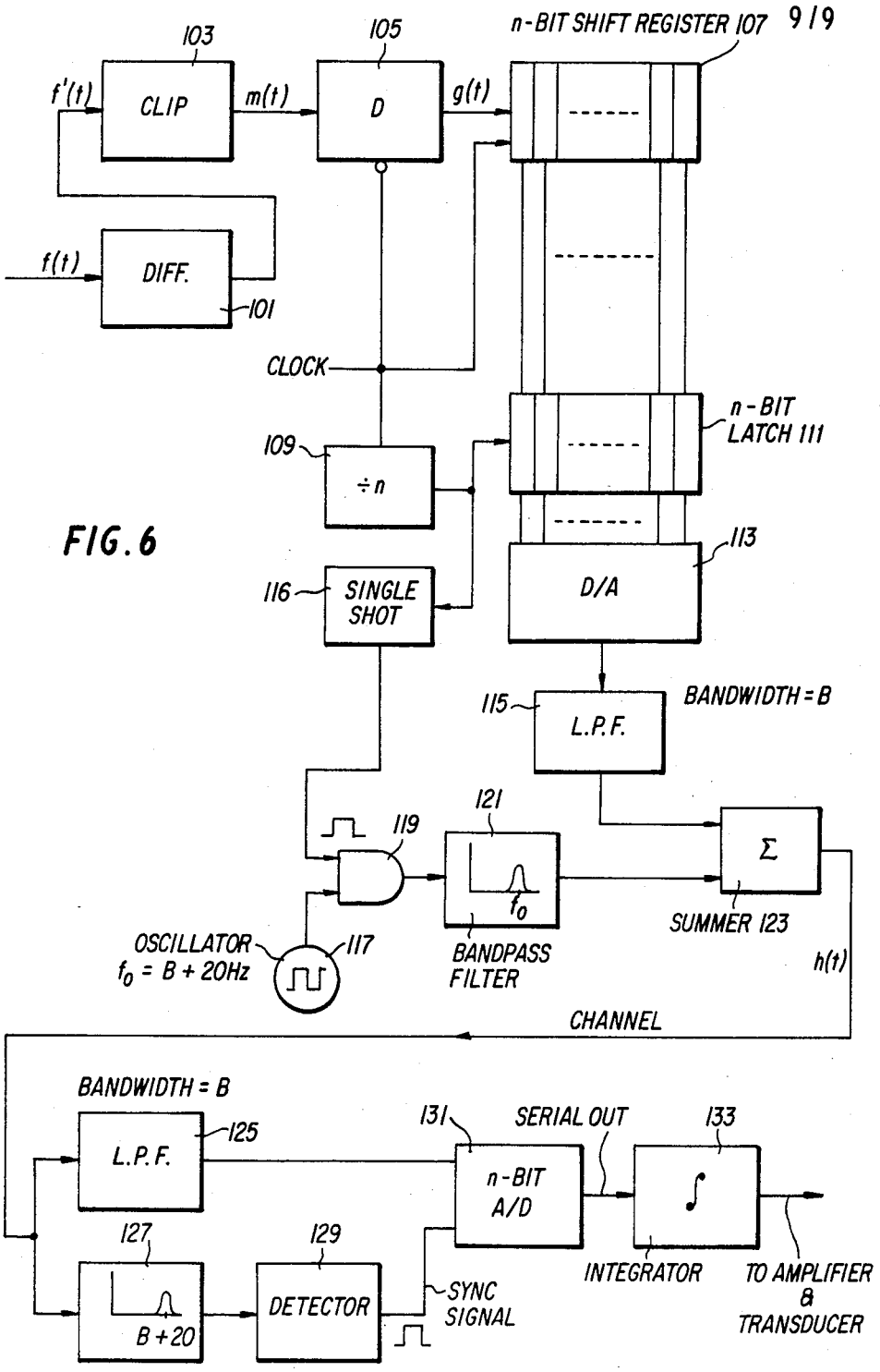
FIG. 6 illustrates how the system may be utilized to obtain analog bandwidth compression.

FIG. 6 illustrates how the system can be used to compress the bandwidths required for transmission of analog signals. The differentiator 101, clipper 103 and D flip-flop 105 function as described before. The output of the D flip-flop is then fed into n-bit shift register 107. A divide by n counter 109 is driven by the clock so as to provide a pulse every n clock cycles. The output of the counter sets an n-bit latch 111 which has its n input lines connected to the n output lines of n-bit shift register 107. When a pulse appears at the output of counter 109, the latch transfers data on its n input lines to its n output lines. An n-bit D/A converter 113 having its n input lines connected to the n-bit latch output converts the binary information into analog form. The output of the D/A is then fed into low pass filter 115 having a bandwidth B. Synchronizing information is obtained by coupling the counter output to a signal shot 116 to provide a synchronizing pulse. A square wave oscillator 117 having a frequency several Hertz above B, e.g. 20 Hz, and the single shot output having a pulse width greater than one oscillator cycle are fed into AND gate 119 to provide a burst of pulses modulated by the synchronizing pulse. The modulated synchronizing signal is then bandpass filtered by bandpass filter 121 to insure that there is sufficient frequency separation. The output of low pass filter 115 and bandpass filter 121 are then summed in summer 123 to provide a signal h(t) containing both the analog data and synchronizing information. The output of summer 123 is then placed on the channel by conventional techniques.

The receiver comprises an A/D converter 131 with serial output and an integrator 133 for recovering the original analog signal f(t), preceded by appropriate low pass, bandpass filters and detector circuitry. A low pass filter 125 separates the analog data from the synchronizing information. The synchronizing signal is obtained by sync separator circuits consisting of bandpass filter 127 and detector 129. Because the information content of the signal g(t) and therefore h(t) is much lower than the analog signal f(t), much less channel bandwidth is necessary for comparable intelligibility than in conventional analog transmission systems.

Figure 7:
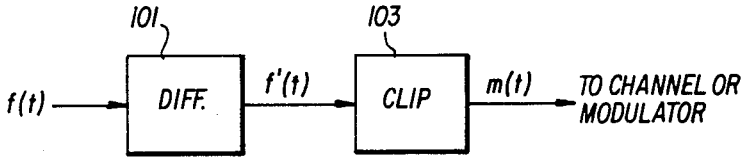
FIG. 7 illustrates how a low noise analog channel can be implemented.

FIG. 7 is a block diagram for a low noise analog channel. In a traditional analog channel, as used for sound transmission, both the signal dynamic range that is allowable by the channel and the transmitter and the channel S/N ratio will limit performance. By using extrema coding, the original analog signal f(t) is represented by a series of binary levels, with transitions corresponding to extrema. Because a binary signal has minimal dynamic range, the dynamic range characteristics of the channel are relatively unimportant, and channel design may be simplified. Additionally, because binary signals have a relatively great noise immunity, noise reduction is possible over conventional analog systems. As shown in FIG. 7, the basic system comprises differentiator 101 and broadband clipper 103. The signal is recovered at the receiver end by a suitable pulse shaper such as a low pass filter or integrator.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. An apparatus for processing an analog signal comprising:

(a) means for detecting the times of occurrence of minimum and maximum values of said signal, thereby producing a detected signal;

(b) means for providing substantially random noise to said signal or said detected signal, said noise being superimposed thereon and having a broadband spectrum having frequencies in a frequency range substantially higher than the highest frequency in said analog signal, said noise being one of injected or naturally present in said signal or detected signal; and (c) means coupled to said means for detecting for encoding only said times of occurrence of minimum and maximum values of said analog signal in the presence of said noise as an encoded signal, said encoding means having a bandwidth greater than the bandwidth of said analog signal, said encoded signal containing information sufficient to enable substantial reproduction of said analog signal therefrom.

2. The apparatus recited in claim 1 wherein:

(a) said detecting means comprises a differentiator for converting said times of occurrences of minimum and maximum values into time axis zero crossings; and (b) said encoding means comprises clipping means for encoding said time axis zero crossings into transitions of a binary signal.

3. The apparatus recited in claim 2 wherein said clipping means is responsive to frequencies at least up to 50 KHz.

4. The apparatus recited in claim 1 or 2 and further comprising:

(a) means for producing clock pulses; and (b) means coupled to said encoding means receiving said encoded signal as an input for synchronizing said encoded signal with said clock pulses, so as to produce a synchronous binary signal.

5. An apparatus for processing an analog signal, the bandwidth of which can be reduced without subjective loss of quality to the human sensory system when said signal is reproduced comprising:

(a) means for detecting the times of occurrence of minimum and maximum values of said signal including the times of occurrence of minimum and maximum values of substantially random noise superimposed thereon, said noise having a broadband spectrum having frequencies in a frequency range substantially higher than the highest frequency in said analog signal; and (b) means coupled to said means for detecting for encoding only said times of occurrence of minimum and maximum values as an encoded signal, said encoding means having a bandwidth greater than the bandwidth of said analog signal, whereby said encoding means encodes the times of occurrence of minimum and maximum values of said signal having said noise superimposed thereon thereby encoding the times of occurrence of the minimum and maximum values of said analog signal and said noise as said encoded signal, said encoded signal containing information sufficient to enable substantial reproduction of said analog signal therefrom.

6. The apparatus recited in claim 5 wherein:

(a) said detecting means comprises a differentiator for converting said times of occurrences of minimum and maximum values into time axis zero crossings; and (b) said encoding means comprises clipping means for encoding said time axes zero crossings into transistions of a binary signal.

7. The apparatus recited in claim 6 wherein said clipping means is responsive to frequencies at least up to 50 KHz.

8. The apparatus recited in claim 5 or 6 and further comprising:

means coupled to said encoding means receiving said encoded signal as an input for producing a signal subjectively the same as said analog signal to the human sensory system.

9. The apparatus recited in claim 8 wherein said means for reproducing is an integrator.

10. The apparatus recited in claim 5 or 6 and further comprising:

(a) means for producing clock pulses; and (b) means coupled to said encoding means receiving said encoded signal as an input for synchronizing said encoded signal with said clock pulses, so as to produce a synchronous binary signal.

11. The apparatus recited in claim 10 wherein:

said means for synchronizing comprises a D flip-flop.

12. The apparatus recited in claim 10 and further comprising:

means coupled to said synchronizing means having said synchronous binary signal as an input for reproducing a signal subjectively the same as said analog signal to the human sensory system.

13. The apparatus recited in claim 12 wherein said reproducing means comprises a pair of monostable multivibrators, said multivibrators producing output pulses shorter than the pulses of said synchronous binary signal, one of said multivibrators producing a pulse on positive transitions of said synchronous binary signal, and the other of said multivibrators producing pulses on negative transitions of said synchronous binary signal.

14. A hearing aid for processing an audio signal comprising:

(a) means for detecting the times of occurrence of minimum and maximum values of said signal including the times of occurrence of minimum and maximum values of substantially random noise superimposed thereon, said noise having a broadband spectrum having frequencies in a frequency range substantially higher than the highest frequency in said analog signal; and (b) means coupled to said means for detecting for encoding only said times of occurrence of minimum and maximum values as an encoded signal, said encoding means having a bandwidth greater than the bandwidth of said analog signal, whereby said encoding means encodes the times of occurrence of minimum and maximum values of said signal having said noise superimposed thereon thereby encoding the times of occurrence of the minimum and maximum values of said analog signal and said noise as said encoded signal, said encoded signal containing information sufficient to enable reproduction of an intelligible signal corresponding to said analog signal to a hearing impaired person.

15. The hearing aid recited in claim 14 and further comprising means coupled to said encoding means receiving said encoded signal as an input for reproducing an intelligible signal corresponding to said analog signal to a hearing impaired person.

16. A low data rate synchronous communications device having an analog signal as an input and a binary synchronous signal as an output comprising:

(a) means for detecting the times of occurrence of minimum and maximum values of said analog signal including the times of occurrence of minimum and maximum values of substantially random noise superimposed thereon, said noise having a broadband spectrum having frequencies in a frequency range substantially higher than the highest frequency in said analog signal;

(b) means coupled to said means for detecting for encoding only said times of occurrence of minimum and maximum values as transitions of an asynchronous binary signal, said encoding means having a bandwidth greater than the bandwidth of said analog signal, whereby said encoding means encodes the times of occurrence of minimum and maximum values of said signal having said noise superimposed thereon thereby encoding the times of occurrence of the minimum and maximum values of said analog signal and said noise as said binary signal, said binary signal containing information sufficient to enable substantial reproduction of said analog signal therefrom; and (c) means coupled to said encoding means receiving said binary signal as an input for synchronizing said binary signal with a repetitive signal so as to produce a synchronous binary signal.

17. A low noise analog communications device having an analog signal as an input comprising:

(a) means for detecting the times of occurrence of minimum and maximum values of said analog signal including the times of occurrence of minimum and maximum values of substantially random noise superimposed thereon, said noise having a broadband spectrum having frequencies in a frequency range substantially higher than the highest frequency in said analog signal; and (b) means coupled to said means for detecting for encoding only said times of occurrence of minimum and maximum values as an encoded signal, said encoding means having a bandwidth greater than the bandwidth of said analog signal, whereby said encoding means encodes the times of occurrence of minimum and maximum values of said signal having said noise superimposed thereon thereby encoding the times of occurrence of the minimum and maximum values of said analog signal and said noise as said encoded signal, said encoded signal containing information sufficient to enable substantial reproduction of said analog signal therefrom.

18. The low noise analog communications device recited in claim 17 wherein:

(a) said detecting means comprises a differentiator for converting said times of occurrences of minimum and maximum values into time axis zero crossings; and (b) said encoded signal is an asynchronous binary signal; and further comprising means having said asynchronous binary signal as an input for bandlimiting said asynchronous signal.

19. An apparatus comprising a transmitter for compressing the bandwidth of a first analog signal received as an input, and a receiver for recovering said analog signal, said transmitter comprising:

(a) means for detecting the times of occurrence of minimum and maximum values of said first signal including the times of occurrence of minimum and maximum values of substantially random noise superimposed thereon, said noise having a broadband spectrum having frequencies in a frequency range substantially higher than the highest frequency in said analog signal;

(b) means coupled to said means for detecting for encoding only said times of occurrence of minimum and maximum values as an encoded signal, said encoding means having a bandwidth greater than the bandwidth of said first analog signal, whereby said encoding means encodes the times of occurrence of minimum and maximum values of said signal having said noise superimposed thereon thereby encoding the times of occurrence of the minimum and maximum values of said first signal and said noise as said encoded signal, said encoded signal containing information sufficient to enable substantial reproduction of said first analog signal therefrom;

(c) means coupled to said encoding means for synchronizing said encoded signal with a repetitive signal, so as to produce a synchronous binary signal; and (d) means for converting said synchronous binary signal into a second analog signal for transmission to a receiver, said receiver comprising:

(i) means for converting said second analog signal into a digital signal; and (ii) means for reproducing said analog signal from said digital signal.

20. A method for processing an analog signal comprising the steps of:

(a) detecting the times of occurrence of minimum and maximum values of said signal including the times of occurrence of minimum and maximum values of substantially random noise superimposed thereon, said noise having a broadband spectrum having frequencies in a frequency range substantially higher than the highest frequency in said analog signal; and (b) encoding only said times of occurrence of minimum and maximum values with encoding means having a bandwidth greater than the bandwidth of said analog signal, whereby said encoding means encodes the times of occurrence of minimum and maximum values of said signal having said noise superimposed thereon thereby encoding the times of occurrence of the minimum and maximum values of said analog signal and said noise into an encoded signal containing information sufficient to enable substantial reproduction of said analog signal therefrom.

21. The method recited in claim 20 and further comprising the step of synchronizing said encoded signal with a repetitive signal, so as to produce a synchronous binary signal.

22. A method of presenting to the human sensory system information contained in an analog signal comprising the steps of processing said analog signal and substantially random noise superimposed thereon into an encoded signal containing information corresponding only to the times of occurrence of the minimum and maximum values of said analog signal including the times of occurrence of minimum and maximum values of the noise superimposed thereon, said noise having a broadband spectrum having frequencies in a frequency range substantially higher than the highest frequency in said analog signal and presenting said encoded signal to the human sensory system whereby said encoded signal is perceived to be substantially the same as said analog signal.

23. A method of presenting to the human sensory system information contained in an analog signal comprising the steps of:

(a) representing information in an encoded signal about the amplitude of said analog signal substantially in terms of the times of occurrence of minimum and maximum values of said analog signal including the times of occurrence of minimum and maximum values of substantially random noise superimposed thereon, said noise having a broadband spectrum having frequencies in a frequency range substantially higher than the highest frequency in said analog signal; and (b) representing information about the frequencies contained in said analog signal substantially in terms of the occurrence of repetitive features of said encoded signal;

whereby said encoded signal contains information such that said encoded signal is perceived by the human sensory system to be substantially the same as said analog signal.

24. The method recited in claim 23 wherein said encoded signal is a binary signal and said times of occurrence of minimum and maximum values are represented by transitions of said binary signal.

25. The apparatus recited in claim 5, further comprising means for injecting broadband, substantially random noise into said apparatus when insufficient naturally occurring noise is present.

26. The method recited in claim 20, further comprising the step of injecting broadband, substantially random noise when insufficient naturally occurring noise is present.

27. The method recited in claim 22, further comprising the step of injecting broadband, substantially random noise when insufficient naturally occurring noise is present.

28. An apparatus for processing an analog signal having time dependent features such as maximum and minimum points and zero crossings comprising:

means for emphasizing the high frequency content of said analog signal including substantially random noise superimposed on said analog signal, said noise having a broadband spectrum having frequencies in a frequency range substantially higher than the highest frequency in said analog signal; and means coupled to said means for emphasizing for encoding selected ones of the time dependent features of selected portions of said analog signal and said noise as an encoded signal, said encoding means having a bandwidth greater than the bandwidth of said analog signal, whereby said encoding means encodes the selected time dependent features of said noise and said analog signal as said encoded signal, said encoded signal containing information sufficient to enable substantial reproduction of said analog signal therefrom.

29. The apparatus recited in claim 28 wherein said means for emphasizing comprises means for detecting the times of occurrence of minimum and maximum values of said signal including the times of occurrence of minimum and maximum values of said noise and wherein said means for encoding comprises means for encoding only said times of occurrence of minimum and maximum values as said encoded signal.

30. The apparatus recited in claim 29 wherein:

said detecting means comprises differentiating means for converting said times of occurrence of minimum and maximum values into time axis zero crossings; and said encoding means comprises clipping means for encoding said time axis zero crossings into transitions of a binary signal.

31. The apparatus recited in claim 30 wherein said clipping means is responsive to frequencies at least up to 50 KHz.

32. The apparatus recited in claim 29 and further comprising:

means for producing clock pulses; and means coupled to said encoding means receiving said encoded signal as an input for synchronizing said encoded signal with said clock pulses, so as to produce a synchronous binary signal.

33. The apparatus recited in claim 29, further comprising means for injecting broadband, substantially random noise into said apparatus when insufficient naturally occurring noise is present.

34. A method for processing an analog signal having time dependent features such as maximum and minimum points and zero crossings comprising the steps of:

emphasizing the high frequency content of said analog signal including substantially random noise superimposed on the analog signal, said noise having a broadband spectrum having frequencies in a frequency range substantially higher than the highest frequency in said analog signal; and encoding selected ones of the time dependent features of selected portions of said analog signal and said noise as an encoded signal with encoding means having a bandwidth greater than the bandwidth of said analog signal, whereby said encoding means encodes the selected time dependent features of said noise and said analog signal as said encoded signal, said encoded signal containing information sufficient to enable substantial reproduction of said analog signal therefrom.

35. The method recited in claim 34 wherein said step of emphasizing comprises detecting the times of occurrence of minimum and maximum values of said signal including the times of occurrence of minimum and maximum values of said noise and said step of encoding comprises encoding only said times of occurrence of minimum and maximum values as said encoded signal.

36. The method recited in claim 35 wherein:

said step of detecting comprises converting said times of occurrence of minimum and maximum values into time axis zero crossings; and said step of encoding comprises encoding said time axis zero crossings into transitions of a binary signal.

37. The method recited in claim 36 wherein said step of converting comprises differentiating said analog signal and said noise into a differentiated signal and said step of encoding comprises clipping said differentiated signal at frequencies at least up to 50 KHz.

38. The method recited in claim 35 and further comprising the steps of:

producing clock pulses; and synchronizing said encoded signal with said clock pulses, so as to produce a synchronous binary signal.

39. The method recited in claim 35, further comprising the step of injecting broadband, substantially random noise when insufficient naturally occurring noise is present.

* * * * *